US011407077B2

(12) United States Patent
Chen et al.

(10) Patent No.: US 11,407,077 B2
(45) Date of Patent: Aug. 9, 2022

(54) DEVICE FOR REPAIRING APPEARANCE DEFECTS AND REPAIR METHOD

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Guangfei Chen, Beijing (CN); Ketao Ning, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 794 days.

(21) Appl. No.: 16/331,774

(22) PCT Filed: Feb. 11, 2018

(86) PCT No.: PCT/CN2018/076250
§ 371 (c)(1),
(2) Date: Mar. 8, 2019

(87) PCT Pub. No.: WO2018/161787
PCT Pub. Date: Sep. 13, 2018

(65) Prior Publication Data

US 2020/0180097 A1 Jun. 11, 2020

(30) Foreign Application Priority Data

Mar. 6, 2017 (CN) ..... 201720210408.0

(51) Int. Cl.
*B24B 7/24* (2006.01)

(52) U.S. Cl.
CPC ..... *B24B 7/242* (2013.01); *B24B 7/241* (2013.01)

(58) Field of Classification Search
CPC ..... B24B 7/224; B24B 7/24; B24B 7/242; B24B 7/244; B24B 7/247; B24B 7/248; B24B 13/0031; B24B 29/08; B24B 7/06
(Continued)

(56) References Cited

U.S. PATENT DOCUMENTS 7,207,862 B2 * 4/2007 Nabeya ..... B24B 37/005 451/36

FOREIGN PATENT DOCUMENTS

CN 203284325 U 11/2013
CN 204019302 U 12/2014
(Continued)

OTHER PUBLICATIONS

International Search Report dated May 21, 2018 corresponding to application No. PCT/CN2018/076250.

*Primary Examiner* — Katina N. Henson
(74) *Attorney, Agent, or Firm* — Nath, Goldberg & Meyer; Joshua B. Goldberg

(57) ABSTRACT

The present disclosure provides a device for repairing appearance defects and repair method. The device comprises: a moving platform and at least one repair mechanism, each the repair mechanism comprises at least one sub-repair mechanism, each the sub-repair mechanism comprises a first moving portion, a second moving portion, and a repair portion; the moving platform is configured to support an apparatus to be repaired and move in a first direction to drive the apparatus to be repaired to move in the first direction; the first moving portion is configured to move in a second direction to drive the repair portion to move in the second direction, and the second direction intersects the first direc-
(Continued)

tion perpendicularly; the second moving portion is configured to move in a third direction to drive the repair portion to move in the third direction.

12 Claims, 2 Drawing Sheets

(58) Field of Classification Search
USPC ..... 451/36, 41–42, 57, 60, 103, 105, 109, 451/162, 167, 177, 296, 300, 336, 360, 451/390, 403
See application file for complete search history.

(56) References Cited

FOREIGN PATENT DOCUMENTS

| | | | |
|---|---|---|---|
| CN | 204569733 | U | 8/2015 |
| CN | 206509881 | U | 9/2017 |
| KR | 1020140007188 | A | 1/2014 |

* cited by examiner

DEVICE FOR REPAIRING APPEARANCE DEFECTS AND REPAIR METHOD

This is a National Phase Application filed under 35 U.S.C. 371 as a national stage of PCT/CN2018/076250, filed Feb. 11, 2018, an application claiming the benefit of Chinese Application No. 201720210408.0, filed Mar. 6, 2017, the content of each of which is hereby incorporated by reference in its entirety.

TECHNICAL FIELD

The present disclosure relates to the field of display technologies, and in particular, to a device for repairing appearance defects and repair method.

BACKGROUND

In the production process of panels, touch screens, cover glass, tempered glass, etc., the surface of the glass is frequently in contact with a support (rollers, machine platform and the like of an equipment) or a transmission mechanism. After the long-term use of the equipment, smears, surface defects, glass debris generated during the production process, chemical liquid residue in the process equipment and the like will be formed on the surfaces of the rollers and the machine platform. These uncontrollable factors can easily lead to the appearance defects on the glass surface such as roller marks, residue, dirt, and scratches on the glass surface, which may result in poor viewing experience, affect product rating, reduce product yield, and cause huge economic losses. In the production process of the panels, touch screens, cover glass, tempered glass, etc., the glass is in contact with a large number of equipments, and the appearance defects on the glass surface is difficult to completely avoid.

In the conventional art, a conventional repairing method such as wiping with a dust-free cloth dipped with alcohol and cleaning by holding a hand gun can be used. The conventional repair method requires a large number of personnel to manually wipe, grind and repair the glass with appearance defects. Therefore, it is time-consuming, the labor cost is huge, the repair method is difficult to standardize, and the repair yield and repair rate are seriously affected, which cannot adapt to the needs of large-scale automated production.

SUMMARY

The present disclosure provides a repair system for repairing appearance defects to improve repair yield and repair rate, and repair system is capable of adapting to large-scale automated production.

To achieve the above object, the present disclosure provides a device for repairing appearance defects, comprising: a moving platform and at least one repair mechanism located on the moving platform, wherein each the repair mechanism comprises at least one sub-repair mechanism, each the sub-repair mechanism comprises a first moving portion, a second moving portion, and a repair portion;

the moving platform is configured to support an apparatus to be repaired and move in a first direction to drive the apparatus to be repaired to move in the first direction;

the first moving portion is configured to move in a second direction to drive the repair portion to move in the second direction, and the second direction intersects the first direction perpendicularly;

the second moving portion is configured to move in a third direction to drive the repair portion to move in the third direction, the third direction is perpendicular to a plane in which the first direction and the second direction are located; and the repair portion is configured to repair the apparatus to be repaired.

Alternatively, the number of the repair mechanism is plural, and the repair mechanisms are arranged in parallel.

Alternatively, each repair mechanism comprises a plurality of sub-repair mechanism.

Alternatively, the moving platform comprises a support member and a first drive member;

the support member is configured to support the apparatus to be repaired;

the first drive member is configured to drive the support member to move in the first direction, so as to drive the apparatus to be repaired to move in the first direction.

Alternatively, the first moving portion comprises a base and a second drive member, the second moving portion is disposed on the base, and the repair portion is connected to the second moving portion; and the second drive member is configured to drive the base in the second direction to drive the second moving portion to move in the second direction, and the second moving portion moves in the second direction to drive the repair portion to move in the second direction.

Alternatively, the second moving portion comprises a cylinder, a slider and a slide rail, the cylinder and the slide rail are disposed on the base, the slider is disposed on the slide rail, the repair portion is connected to the slider;

the cylinder is configured to drive the slider to slide on the slide rail in the third direction, and the slider slides on the slide rail in the third direction so as to drive the repair portion to move in the third direction.

Alternatively, each repair mechanism further comprises a third drive member and a long magnet connected to the third drive member, the repair portion comprises a movable magnet, a drive shaft, and an abrasive member, the movable magnet is connected to the second moving portion through the drive shaft, and the abrasive member is connected to the movable magnet through the drive shaft, the long magnet is located vertically below the second moving portion;

the third drive member is configured to drive the long magnet to rotate;

the movable magnet is configured to move in the third direction to a position where the long magnet is located and intersect with the long magnet;

the drive shaft is configured to rotate under an interaction of the movable magnet and the long magnet;

the abrasive member is configured to rotate driven by the drive shaft so as to repair the apparatus to be repaired.

Alternatively, the shape of the abrasive member is spherical.

Alternatively, each sub-repair mechanism further comprises a lubrication portion located above the moving platform;

the lubrication portion is configured to spray a polishing liquid to the abrasive member and to an area on the apparatus to be repaired where is repaired by the abrasive member when the repair portion repairs the apparatus to be repaired.

Alternatively, each sub-repair mechanism further comprises a cleaning portion located above the moving platform;

the cleaning portion is configured to spray a cleaning liquid to an area on the apparatus to be repaired where is repaired by the abrasive member after the repair portion repairs the apparatus to be repaired.

The present disclosure further provides a repair method of the device above, comprising the steps of:

sending an appearance defect coordinate value to a control system to determine a sub-repair mechanism of a repair mechanism performing a repair operation, starting a first drive member of the moving platform, moving an apparatus to be repaired in a first direction, starting a second drive member of a first moving portion of the determined sub-repair mechanism, moving a repair portion of the determined sub-repair mechanism in a second direction such that an abrasive member of the repair portion and a position of appearance defect of the apparatus to be repaired are opposite to each other, starting a third drive member of the repair mechanism, and operating a second moving portion of the sub-repair mechanism to move the repair portion in a third direction such that a movable magnet of the repair portion moves to a position where a long magnet is located and intersects with the long magnet.

Alternatively, the repair method further comprises:

spraying a polishing liquid to the abrasive member and to an area on the apparatus to be repaired where is repaired by the abrasive member when the repair portion repairs the apparatus to be repaired.

Alternatively, the repair method further comprises:

spraying a cleaning liquid to the area on the apparatus to be repaired where is repaired by the abrasive member after the repair portion repairs the apparatus to be repaired.

DETAILED DESCRIPTION OF THE EMBODIMENTS

In order to enable those skilled in the art to better understand the technical solutions of the present disclosure, the device for repairing appearance defects provided by the present disclosure will be described in detail below with reference to the accompanying drawings.

Figure 1:
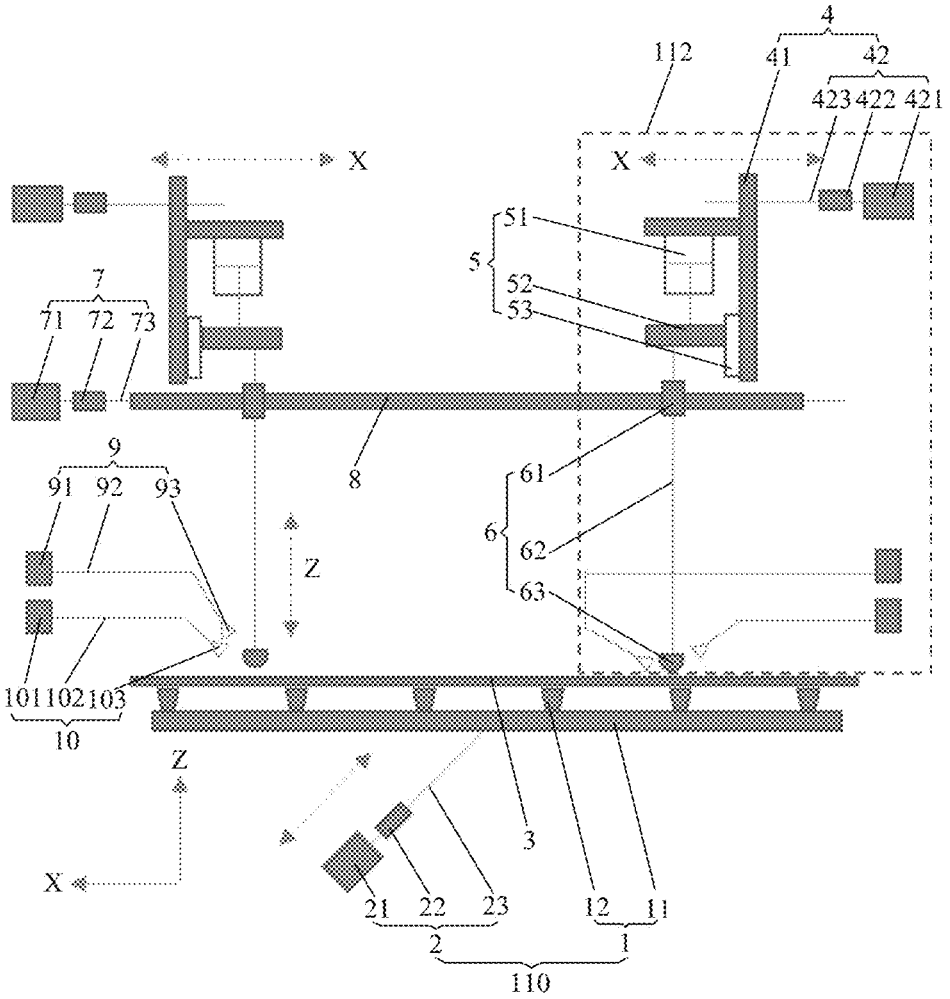
FIG. 1 is a schematic structural diagram of a device for repairing appearance defects according to an embodiment of the present disclosure.
Figure 2:
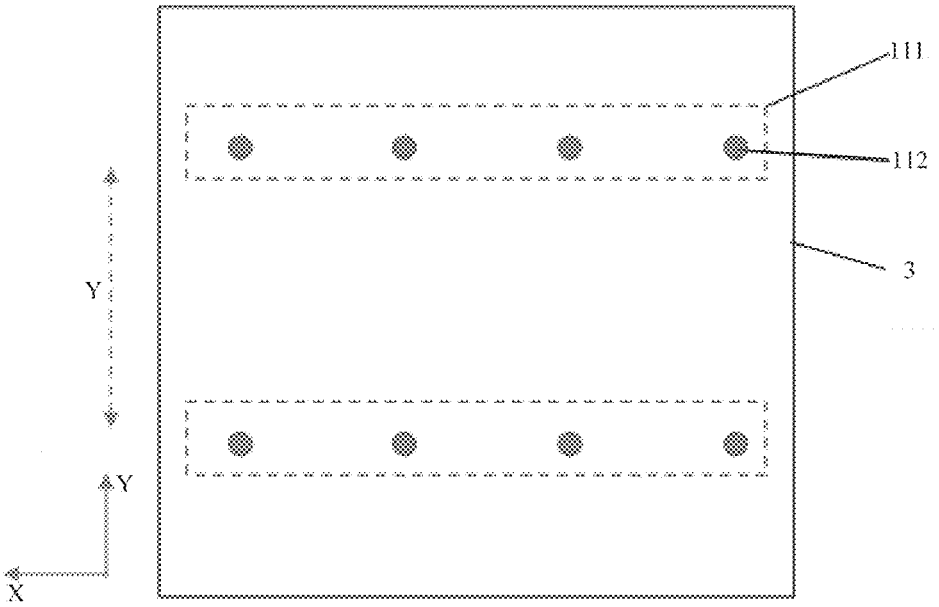
FIG. 2 is a top view of the device for repairing appearance defects in FIG. 1.

FIG. 1 is a schematic structural diagram of a device for repairing appearance defects according to an embodiment of the present disclosure; and FIG. 2 is a top view of the device for repairing appearance defects as shown in FIG. 1. As shown in FIG. 1 and FIG. 2, the device for repairing appearance defects includes: a moving platform 110 and at least one repair mechanism 111 located on the moving platform 110. Each the repair mechanism 111 includes a plurality of sub-repair mechanisms 112. Each of the sub-repair mechanisms 112 includes a first moving portion 4, a second moving portion, 5 and a repair portion 6. The moving platform 110 is configured to support an apparatus to be repaired 3 and move in a first direction to drive the apparatus to be repaired 3 to move in the first direction. The first moving portion 4 is configured to move in a second direction to drive the repair portion 6 to move in the second direction, and the second direction intersects the first direction perpendicularly. The second moving portion 5 is configured to move in a third direction to drive the repair portion 6 to move in the third direction, the third direction is perpendicular to a plane in which the first direction and the second direction are located; and the repair portion 6 is configured to repair the apparatus to be repaired 3.

In the present embodiment, preferably, the first direction is the Y direction, the second direction is the X direction, and the third direction is the Z direction. Here, as shown in FIG. 1, the X direction is the lateral direction, the Z direction is the vertical direction, and the Y direction is the direction perpendicular to the paper surface. As shown in FIG. 2, the X direction is the lateral direction, and the Y direction is the longitudinal direction.

In this embodiment, the apparatus to be repaired 3 may be a substrate, for example, the substrate may be a glass substrate.

As shown in FIG. 2, in the embodiment, the number of the repair mechanism 111 is plural, and the repair mechanisms 111 are arranged in parallel. Each repair mechanism 111 can operate independently. Each repair mechanism includes a plurality of sub-repair mechanism 112. In FIG. 2, two repair mechanisms 111 and each repair mechanism having four sub-repair mechanisms 112 are illustrated as an example.

In the embodiment, the moving platform 110 includes a support member 1 and a first drive member 2. The support member 1 is configured to support the apparatus to be repaired 3; and the first drive member 2 is configured to drive the support member 1 to move in the first direction, so as to drive the apparatus to be repaired 3 to move in the first direction. Specifically, the support member 1 includes a pedestal 11 and at least one support unit 12 located above the pedestal 11, wherein the support unit 12 is fixed on the pedestal 11. The support unit 12 is used to support the apparatus to be repaired 3, and the apparatus to be repaired 3 is fixed on the support unit 12. Preferably, the number of the support units 12 is plural, and the six support units 12 are illustrated in FIG. 1 as an example. Specifically, the first drive member 2 includes a motor 21, a coupling 22, and a lead screw 23. The motor 21 and the coupling 22 are connected, and the coupling 22 is connected to the support member 1 through the lead screw 23. Specifically, one end of the lead screw 23 is connected to the coupling 22, and the other end of the lead screw 23 is connected to the support member 1. The coupling 22 is connected to the pedestal 11 via the lead screw 23. In particular, one end of the lead screw 23 is connected to the coupling 22, and the other end of the lead screw 23 is connected to the pedestal 11.

In this embodiment, the first moving portion 4 includes a base 41 and a second drive member 42, the second moving portion 5 is disposed on the base 41, and the repair portion 6 is connected to the second moving portion 5. The second drive member 42 is configured to drive the base 41 in the second direction (X direction as shown in FIG. 1) to drive the second moving portion 5 to move in the second direction, and the second moving portion 5 moves in the second direction to drive the repair portion 6 to move in the second direction.

In this embodiment, the second moving portion 5 includes a cylinder 51, a slider 52 and a slide rail 53. The cylinder 51 and the slide rail 53 are disposed on the base 41, the slider 52 is disposed on the slide rail 53, and the repair portion 6 is connected to the slider 52. The cylinder 51 is configured to drive the slider 52 to slide on the slide rail 53 in the third direction, and the slider 52 slides on the slide rail 53 in the third direction so as to drive the repair portion 6 to move in the third direction.

Alternatively, in practical applications, the second moving portion 5 may include a motor, a coupling, and a lead screw. The motor and the coupling are connected, and the coupling is connected to an abrasive member by the lead screw. Specifically, one end of the lead screw is connected to the coupling, and the other end of the lead screw is connected to the abrasive member. The motor rotates, through the coupling and the lead screw, to drive the repair portion 6 to move in the third direction. The lead screw has high transmission precision hence it is convenient for adjusting a moving distance of the repair portion 6 in the third direction.

Specifically, the second drive member 42 includes a motor 421, a coupling 422, and a lead screw 423. The motor 421 is connected to the coupling 422, and the coupling 422 is connected to the base 41 through the lead screw 423. Specifically, one end of the lead screw 423 is connected to the coupling 422, and the other end of the lead screw 423 is connected to the base 41.

In this embodiment, each repair mechanism 111 further includes a third drive member 7 and a long magnet 8 connected to the third drive member 7. The repair portion 6 includes a movable magnet 61, a drive shaft 62, and an abrasive member 63, the movable magnet 61 is connected to the second moving portion 5 through the drive shaft 62, and the abrasive member 63 is connected to the movable magnet 61 through the drive shaft 62. The long magnet 8 is located below the second moving portion 5. The third drive member 7 is configured to drive the long magnet 8 to rotate. The movable magnet 61 is configured to move in the third direction to a position where the long magnet 8 is located and intersect with the long magnet 8. The drive shaft 62 is configured to rotate under an interaction of the movable magnet 61 and the long magnet 8. The abrasive member 63 can rotate together with the drive shaft 62 so as to repair the apparatus to be repaired 3. Specifically, when the movable magnet 61 is moved to the long magnet 8 and in an intersecting state with the long magnet 8, a magnetic force is generated between the long magnet 8 and the movable magnet 61. When the long magnet 8 rotates, the movable magnet 61 also rotates under the action of the magnetic force, thereby causing the drive shaft 62 to rotate. When the state of the long magnet 8 and the movable magnet 61 are changed from the intersecting state to a disengaging state, that is, when the long magnet 8 and the movable magnet 61 do not intersect, the magnetic force between the long magnet 8 and the movable magnet 61 disappears, thus, the movable magnet 61 stops rotating.

Preferably, the shape of the abrasive member 63 is spherical. In practical applications, the shape of the abrasive member 63 may also adopt other shapes, which are not enumerated here.

Specifically, the third drive member 7 includes a motor 71, a coupling 72, and a lead screw 73. The motor 71 is connected to the coupling 72, and the coupling 72 is connected to the long magnet 8 through the lead screw 73. Specifically, one end of the lead screw 73 is connected to the coupling 72, and the other end of the lead screw 73 is connected to the long magnet 8.

In this embodiment, each sub-repair mechanism 112 further includes a lubrication portion 9 located above the moving platform 110. The lubrication portion 9 is configured to spray a polishing liquid to the abrasive member 63 and to an area on the apparatus to be repaired 3 where is repaired by the abrasive member 63 when the repair portion 6 repairs the apparatus to be repaired 3. Specifically, the lubrication portion 9 includes a polishing liquid solenoid valve 91, a polishing liquid hose 92, and a polishing liquid nozzle 93. One end of the polishing liquid hose 92 is connected to the polishing liquid solenoid valve 91, and the other end of the polishing liquid hose 92 is connected to the polishing liquid nozzle 93.

In this embodiment, each sub-repair mechanism 112 further includes a cleaning portion 10 located above the moving platform 110. The cleaning portion 10 is configured to spray a cleaning liquid to an area on the apparatus to be repaired 3 where is repaired by the abrasive member 63 after the repair portion 6 repairs the apparatus to be repaired 3. Specifically, the cleaning portion 10 includes a high-pressure water solenoid valve 101, a high-pressure water hose 102, and a high-pressure water nozzle 103. One end of the high-pressure water hose 102 is connected to the high-pressure water solenoid valve 101, and the other end of the high-pressure water hose 102 is connected to the high-pressure water nozzle 103.

The operation process of the device for repairing appearance defects in the present embodiment will be described in detail below with reference to FIGS. 1 and 2.

When appearance defects are occurred on the apparatus to be repaired 3, the operator manually inputs an appearance defect coordinate value on the human-machine interface, and then sends the appearance defect coordinate value to a control system (not shown) of the device for repairing appearance defects. Alternatively, the Computer Integrated Manufacturing (CIM) sends the appearance defect coordinate value to the control system. The control system determines, based on an effective stroke of each of the repair mechanism 111 and the sub-repair mechanism 112, a specific repair mechanism 111 and a corresponding sub-repair mechanism 112 that perform the repair operation.

Starting the motor 21 of the first drive member 2, driving the support member 1 by the coupling 22 and the lead screw 23 to move in the first direction to a position under the determined sub-repair mechanism 112, so as to drive the apparatus to be repaired 3 to move to the position under the determined sub-repair mechanism 112.

Starting the motor 421 of the second drive member 42, driving the base 41 by the coupling 422 and the lead screw 423 to move in the second direction to a upper position above the appearance defects of the apparatus to be repaired 3, so as to drive the repair portion 6 to move to the upper position above the appearance defects of the apparatus to be repaired 3. At this time, the abrasive member 63 in the repair portion 6 is positioned above the appearance defects of the apparatus to be repaired 3, that is, the abrasive member 63 in the repair portion 6 and the appearance defects of the apparatus to be repaired 3 are opposed to each other.

Starting the motor 71 of the third drive member 7, and the long magnet 8 is driven to rotate by the coupling 72 and the lead screw 73.

The cylinder 51 of the second moving portion 5 provides power to drive the slider 52 to slide downward (in the third direction) on the slide rail 53 to drive the repair portion 6 to move downward, so that the abrasive member 63 of the repair portion 6 is in contact with a position of the appearance defects of the apparatus to be repaired 3, and the movable magnet 61 of the repair portion 6 is moved to the position where the long magnet 8 is located and intersects with the long magnet 8. In this state, the drive shaft 62 is rotatable under the interaction of the movable magnet 61 and the long magnet 8. The abrasive member 63 is used to rotate at a high speed driven by the drive shaft 62, thereby starting to repair the appearance defects of the apparatus to be repaired 3. The abrasive member 63 can remove the surface material at the position of the appearance defects of the apparatus to be repaired 3, thereby achieving the purpose of repairing the appearance defects of the apparatus to be repaired 3.

In the process in which the abrasive member 63 repairs the appearance defects of the apparatus to be repaired 3, the polishing liquid solenoid valve 91 is opened, and the polishing liquid reaches the polishing liquid nozzle 93 through the polishing liquid hose 92. The polishing liquid is sprayed by the polishing liquid nozzle 93 to the abrasive member 63 and to an area on the apparatus to be repaired 3 where is repaired by the abrasive member 63 (that is, appearance defects position). Therefore, lubrication of the apparatus to be repaired 3 and the abrasive member 63 during the repair process is achieved, thereby reducing the occurrence of secondary defects.

After the appearance defects of the apparatus to be repaired 3 is repaired by the abrasive member 63, the cylinder 51 of the second moving portion 5 supplies power to drive the slider 52 to slide upward on the slide rail 53, so as to drive the repair portion 6 to move upward, so that the abrasive member 63 of the repair portion 6 is away from the apparatus to be repaired 3. At the same time, the movable magnet 61 of the repair portion 6 is away from the long magnet 8, and the state of the movable magnet 61 and the long magnet 8 is changed from the intersecting state to the disengaging state, so that both of the drive shaft 62 and the abrasive member 63 loss power and stop rotating.

Next, the polishing liquid solenoid valve 91 is closed so that the polishing liquid nozzle 93 stops spraying the polishing liquid. Thereafter, the high-pressure water solenoid valve 101 is opened, and the cleaning liquid reaches the high-pressure water nozzle 103 via the high-pressure water hose 102, and the cleaning liquid is sprayed by the high-pressure water nozzle 103 to the area on the apparatus to be repaired 3 where is repaired by the abrasive member 63 (appearance defects position). Preferably, the cleaning liquid is high-pressure clean water, thereby cleaning of the area where is repaired by the abrasive member 63 is achieved.

The device for repairing appearance defects provided by the present embodiment includes: a moving platform and at least one repair mechanism located on the moving platform, wherein each the repair mechanism includes at least one sub-repair mechanism, each the sub-repair mechanism includes a first moving portion, a second moving portion, and a repair portion. The device for repairing the appearance defects of the present embodiment does not need to manually repair the appearance defects. The device for repairing the appearance defects can realize automatic repair, standardize the repair process, reduce the repair time and repair cost, improve the repair yield and the repair rate, thereby adapting to large-scale automated production. The present disclosure can easily and quickly realize the rotation, the movement in the lateral or vertical direction, and the like of the abrasive member. The present disclosure is suitable for repairing of the surface with roller marks, residue, dirt, scratches on the apparatus to be repaired. The present disclosure can be operated in full-automation and the operation is simple and convenient. Regarding each product, only the appearance defect coordinate value needs to be input on the human-machine interface of the device or to be received by the CIM, then the repair portion can automatically move to the specific location of the appearance defects of the apparatus to be repaired. Therefore, automatic repair is achieved. The lubrication portion can automatically turn on or off the polishing liquid for a certain time according to a moving position of the repair portion, and the cleaning portion can automatically turn on or off the cleaning liquid for a certain time according to the moving position of the repair portion. The present disclosure includes at least one repair mechanism, and each repair mechanism can include a plurality of sub-repair mechanisms, so that repair can be simultaneously performed for a plurality of appearance defects, thereby greatly improving repair efficiency. The disclosure does not require the operator to manually adjust the position of the repair portion, and does not need to manually add the polishing liquid and the cleaning liquid, thereby greatly shortening the repair time of the appearance defects and the wiping time of the apparatus to be repaired after the repair. Thereby, the equipment utilization rate is improved; and the workload for the operator is decreased. The present disclosure has a good effect on repairing of the appearance defects, low maintenance cost, and good application prospect.

It is to be understood that the above embodiments are merely exemplary embodiments employed to explain the principles of the present disclosure, but the present disclosure is not limited thereto. Various modifications and improvements can be made by those skilled in the art without departing from the spirit and scope of the disclosure, and such modifications and improvements are also considered to be within the scope of the disclosure.

What is claimed is:

1. A device for repairing appearance defects, comprising: a moving platform and at least one repair mechanism located on the moving platform, wherein each repair mechanism of the at least one repair mechanism comprises at least one sub-repair mechanism, each sub-repair mechanism of the at least one sub-repair mechanism comprises a first moving portion, a second moving portion, and a repair portion;

the moving platform is configured to support an apparatus to be repaired and move in a first direction to drive the apparatus to be repaired to move in the first direction;

the first moving portion is configured to move in a second direction to drive the repair portion to move in the second direction, and the second direction intersects the first direction perpendicularly;

the second moving portion is configured to move in a third direction to drive the repair portion to move in the third direction, the third direction is perpendicular to a plane in which the first direction and the second direction are located; and the repair portion is configured to repair the apparatus to be repaired, wherein each repair mechanism further comprises a third drive member and a long magnet connected to the third drive member, the repair portion comprises a movable magnet, a drive shaft, and an abrasive member, the movable magnet is connected to the second moving portion through the drive shaft, and the abrasive member is connected to the movable magnet through the drive shaft, the long magnet is located vertically below the second moving portion;

the third drive member is configured to drive the long magnet to rotate;

the movable magnet is configured to move in the third direction to a position where the long magnet is located and intersect with the long magnet;

the drive shaft is configured to rotate under an interaction of the movable magnet and the long magnet;

the abrasive member is configured to rotate driven by the drive shaft so as to repair the apparatus to be repaired.

2. The device according to claim 1, wherein the number of the repair mechanism is plural, and the repair mechanisms are arranged in parallel.

3. The device according to claim 1, wherein each repair mechanism comprises a plurality of sub-repair mechanism.

4. The device according to claim 1, wherein the moving platform comprises a support member and a first drive member;

the support member is configured to support the apparatus to be repaired;

the first drive member is configured to drive the support member to move in the first direction, so as to drive the apparatus to be repaired to move in the first direction.

5. The device according to claim 1, wherein the first moving portion comprises a base and a second drive member, the second moving portion is disposed on the base, and the repair portion is connected to the second moving portion; and the second drive member is configured to drive the base in the second direction to drive the second moving portion to move in the second direction, and the second moving portion moves in the second direction to drive the repair portion to move in the second direction.

6. The device according to claim 5, wherein the second moving portion comprises a cylinder, a slider and a slide rail, the cylinder and the slide rail are disposed on the base, the slider is disposed on the slide rail, the repair portion is connected to the slider;

the cylinder is configured to drive the slider to slide on the slide rail in the third direction, and the slider slides on the slide rail in the third direction so as to drive the repair portion to move in the third direction.

7. The device according to claim 1, wherein the shape of the abrasive member is spherical.

8. The device according to claim 1, wherein each sub-repair mechanism further comprises a lubrication portion located above the moving platform;

the lubrication portion is configured to spray a polishing liquid to the abrasive member and to an area on the apparatus to be repaired where is repaired by the abrasive member when the repair portion repairs the apparatus to be repaired.

9. The device according to claim 1, wherein each sub-repair mechanism further comprises a cleaning portion located above the moving platform;

the cleaning portion is configured to spray a cleaning liquid to an area on the apparatus to be repaired where is repaired by the abrasive member after the repair portion repairs the apparatus to be repaired.

10. A repair method of a device according to claim 1, comprising the steps of:

sending an appearance defect coordinate value to a control system to determine a sub-repair mechanism of a repair mechanism performing a repair operation, starting a first drive member of the moving platform, moving an apparatus to be repaired in a first direction, starting a second drive member of a first moving portion of the determined sub-repair mechanism, moving a repair portion of the determined sub-repair mechanism in a second direction such that an abrasive member of the repair portion and a position of appearance defect of the apparatus to be repaired are opposite to each other, starting a third drive member of the repair mechanism, and operating a second moving portion of the sub-repair mechanism to move the repair portion in a third direction such that a movable magnet of the repair portion moves to a position where a long magnet is located and intersects with the long magnet.

11. The repair method according to claim 10, further comprising:

spraying a polishing liquid to the abrasive member and to an area on the apparatus to be repaired where is repaired by the abrasive member when the repair portion repairs the apparatus to be repaired.

12. The repair method according to claim 11, further comprising:

spraying a cleaning liquid to the area on the apparatus to be repaired where is repaired by the abrasive member after the repair portion repairs the apparatus to be repaired.

* * * * *